US005353100A

United States Patent [19]

Ohtsuka

[11] Patent Number: 5,353,100

[45] Date of Patent: Oct. 4, 1994

[54] IMAGE APPARATUS WITH REMOVABLE PROCESS KIT ROTATABLE ABOUT A PHOTORECEPTOR SHAFT

[75] Inventor: Yoshinori Ohtsuka, Yamatokoriyama, Japan

[73] Assignee: Sharp Kabushiki Kaisha, Osaka, Japan

[21] Appl. No.: 67,033

[22] Filed: May 26, 1993

[30] Foreign Application Priority Data

May 27, 1992 [JP] Japan ..... 4-134889

[51] Int. Cl.[5] ..... G03G 15/00

[52] U.S. Cl. ..... 355/200; 355/210

[58] Field of Search ..... 355/200, 210; 346/160, 346/157

[56] References Cited

U.S. PATENT DOCUMENTS

| | | | |
|---|---|---|---|
| 4,876,572 | 10/1989 | Nagatsuna | 355/210 |
| 5,047,801 | 9/1991 | Haneda et al. | 355/200 |
| 5,047,803 | 9/1991 | Kanoto | 355/211 |
| 5,061,959 | 10/1991 | Kinoshita et al. | 355/210 |
| 5,083,158 | 1/1992 | Kashima et al. | 355/200 |
| 5,103,261 | 4/1992 | Matsuo et al. | 355/210 |
| 5,115,272 | 5/1992 | Ohmori et al. | 355/200 |
| 5,124,747 | 6/1992 | Haneda et al. | 355/200 |
| 5,136,333 | 8/1992 | Craft et al. | 355/211 |
| 5,153,640 | 10/1992 | Okabe | 355/200 |
| 5,157,416 | 10/1992 | Kinoshita et al. | 346/108 |

FOREIGN PATENT DOCUMENTS

| | | | |
|---|---|---|---|
| 0411825 | 2/1991 | European Pat. Off. | 355/210 A |
| 0473303 | 3/1992 | European Pat. Off. | 355/210 A |
| 61-18181 | 5/1986 | Japan . | |
| 1-155365 | 6/1989 | Japan | 355/210 A |
| 1-172848 | 7/1989 | Japan | 355/210 A |
| 1-316753 | 12/1989 | Japan | 355/210 A |
| 2-297566 | 12/1990 | Japan | 355/210 A |
| 3-123380 | 5/1991 | Japan | 355/210 A |

*Primary Examiner*—R. L. Moses

[57] ABSTRACT

A laser printer is provided with a photoreceptor drum for transferring a toner image formed on a peripheral surface thereof to a sheet by rotating. The photoreceptor drum is stored in a process kit. In order to removably secure the process kit, a space is provided in an upper portion of a main body of the laser printer. A pair of bearings is provided in the process kit along a rotation shaft of the photoreceptor drum. Further, a pair of substantially U-shaped guides is provided for removably supporting the respective bearings in a direction substantially perpendicular to the rotation shaft. In this arrangement, since the installation and removal of the process kit can be done from the position above the main body, both the bearings and the guides can be exposed. This permits the respective positions of the bearings and the guides can be easily recognized, thereby ensuring an easy installation and removal of the process kit.

19 Claims, 5 Drawing Sheets

IMAGE APPARATUS WITH REMOVABLE PROCESS KIT ROTATABLE ABOUT A PHOTORECEPTOR SHAFT

FIELD OF THE INVENTION

The present invention relates to an image forming apparatus which permits installation and removal of a part of an image-forming section as a process kit, the section including a photoreceptor drum.

BACKGROUND OF THE INVENTION some of the image forming apparatuses such as laser printers, etc., are arranged such that a process kit snoring therein a part of an image-forming section is detachable from the main body (for example, see Tokukaisho 61-18181). The process kit includes, for example, a photoreceptor drum, a developer unit for supplying toner to the photoreceptor drum, and a cleaning unit for removing the toner remaining on the photoreceptor drum as one integral part.

In the above image forming apparatus, refill of the toner, retrieval of the used toner, and exchange of the photoreceptor drum which has been deteriorated are carried out in one process by exchanging the process kit with another process kit.

Further, a handle for carrying the process kit is formed at a position corresponding to a center of a rotation shaft of the photoreceptor drum. The handle is set parallel to the rotation shaft of the photoreceptor drum. Therefore, when carrying the process kit, as the photoreceptor drum can be maintained horizontal, the toner in the process kit can be prevented from shifting to one side.

In the above arrangement of the image forming apparatus, when carrying the process kit, even if the toner shifts to one side, the overflow of the toner from the process kit can be prevented. Moreover, even when installing the process kit storing therein the toner which may have shifted to one side, the possibility that a part of an image cannot be developed can be eliminated.

The above image forming apparatus is arranged such that the installation and removal of the process kit are carried out from the front face of the main body by moving it in a direction of the rotation shaft of the photoreceptor drum. More concretely, projected portions which extend in a direction parallel to the rotation shaft of the photoreceptor drum are formed on both sides of the process kit. Further, the projected portions are respectively guided by guide rails provided in the main body. When installing the process kit in the main body, the bottom surfaces of the projected portions are respectively placed on the guide rails, then the process kit is moved along the direction of the rotation shaft of the photoreceptor drum.

However, in the above conventional model, when installing the process kit in the main body, because the process kit is contained within the main body, it is difficult to recognize the state of the process kit from outside. Therefore, there is a possibility of installing the process kit in the main body wrongly, and if this occurs, the proper image forming process may not be achieved.

Moreover, when a sheet gets stuck between the process kit and the main body, the state of the sheet being stuck cannot be recognized until the smooth movement of the process kit is interfered when the process kit is pulled to some extent.

Furthermore, if the process kit in the above state is taken out, since the sheet being stuck will be more badly damaged, the smooth movement of the process kit will be hindered. In the above state, if the process kit is forced to be taken out, the damaged sheet remains on both the process kit and the main body, and it will take a long time to take out the damaged sheet.

SUMMARY OF THE INVENTION

An object of the present invention is to provide an image forming apparatus which ensures an installation and removal of a process kit which is removably secured in a main body.

In order to achieve the above object, the image forming apparatus in accordance with the present invention is characterized by including:

- a photoreceptor drum for transferring an image formed on a peripheral surface thereof to a transfer material by rotating;
- enclosing means for enclosing the photoreceptor drum;
- a main body with a space for the enclosing means in an upper portion, the space being provided so as to enable an installation and a removal of the enclosing means;
- a pair of projected members with a central axis thereof set parallel to a rotation shaft of the photoreceptor drum, the pair of projected members being secured to the enclosing means; and
- a pair of support me:tubers for respectively guiding the pair of projected members, and for removably supporting the pair of projected members so as to face the space, and
- wherein the enclosing means is installed in or removed from the upper portion of the main body by moving in a direction substantially perpendicular to the rotation shaft of the photoreceptor drum.

According to the above arrangement, the enclosing means can be removably secured so as to fit in the space provided in the upper portion of the main body by guiding the projected members using the respective support members. In this way, the enclosing means can be exposed both while being installed and after being .installed. Because this enables the state of the enclosing means to be easily recognized, the possibility of setting the enclosing means wrongly can be eliminated, thereby ensuring the installation and removal of the enclosing means.

The transfer material transported in or from the enclosing means in a direction substantially perpendicular to the rotation shaft of the photoreceptor drum may get stuck between the enclosing means and the main body. In this case, however, because the enclosing means is removably secured by moving in a direction substantially perpendicular to the rotation shaft of the photoreceptor drum, the transfer material can be transported along a transport path when moving the enclosing means to be removed.

In the above arrangement, since the transfer material will not hinder the movement of the enclosing means, smooth removal of the enclosing means can be ensured. Moreover even if the transfer material gets stuck in the apparatus, because the possibility of the transfer material being damaged can be eliminated, the transfer material stuck the apparatus can be easily removed.

For a fuller understanding of the nature and advantages of the invention, reference should be made to the ensuing detailed description taken in conjunction with the accompanying drawings.

DESCRIPTION OF THE EMBODIMENTS

Figure 1:
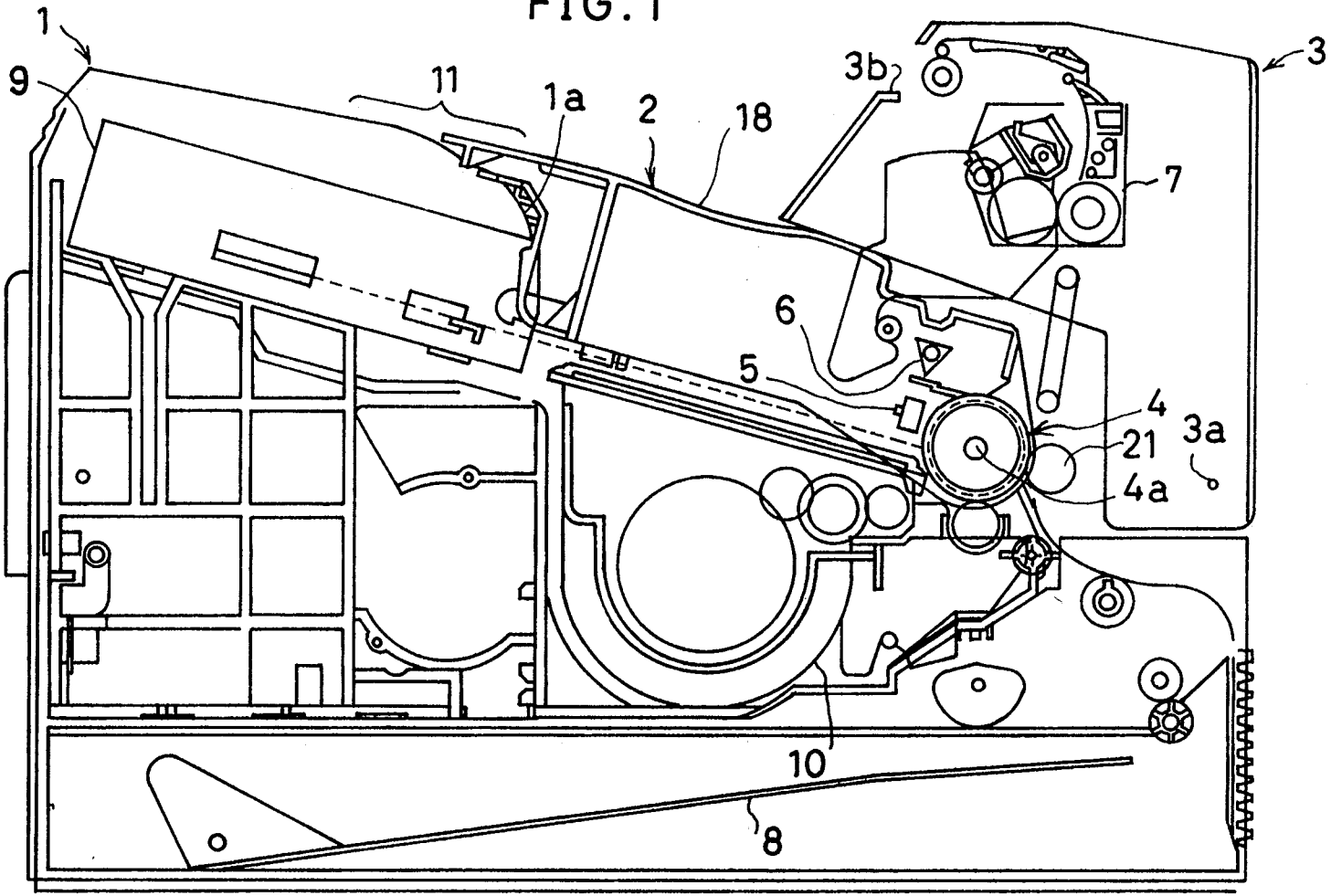
FIG. 1 is a view showing a schematic configuration of an image forming apparatus of the present invention.

As shown in FIG. 1, a laser printer (image forming apparatus) of the present embodiment is composed of a box-shaped main body 1 provided with a process kit 2 and a hood 3 which covers the back portion of the main body 1. The process kit 2 is disposable, and stores therein a photoreceptor drum 4, a main charger 5, and a cleaning unit 6. In order to arrange the process kit 2 to be removably secured to the upper portion of the main body 1, a space 1*a* for the process kit 2 is formed in the upper portion of the main body 1.

The photoreceptor drum 4 is formed in a cylindrical shape, and is provided in the process kit 2 so as to be rotatable around a rotation shaft 4a as a central axis. On the peripheral surface of the photoreceptor drum 4, a photoconductive layer is formed. While rotating the photoreceptor drum 4 in a counterclockwise direction, the peripheral surface thereof is exposed by an optical system 9 (to be described later), thereby forming thereon a static latent image. Thereafter, the static latent image developed using toner supplied from a developer unit 10 (to be described later), thereby forming a toner image on the photoconductive layer of the photoreceptor drum 4. Then, the toner image is transferred to a sheet (transfer material).

The cleaning unit 6 is provided for removing toner remaining on the photoreceptor drum 4. The cleaning unit 6 includes a case for disposing of the collected used toner. The main charger 5 is provided for uniformly charging the photoconductive layer before exposure.

On both sides of the back portion of the main body 1, a pair of substantially cylindrical pins 3*a* is provided. The pin 3*a* is provided in such a manner that a central axis thereof is set parallel to the rotation shaft 4*a* of the photoreceptor drum 4 installed in the main body 1. The hood 3 is provided on the main body 1 so as to be freely rotatable around the pins 3*a*.

The hood 3 stores therein a fuser 7 which makes a toner image permanent on a sheet fed from the process kit 2. Thus, the hood 3 is provided so as to be rotatable between a closed position at which sheets fed from the process kit 2 can be fed into the fuser 7 and an opened position at which the installation and removal of the process kit 2 is permitted.

A discharge opening 3*b* is formed in the hood 3 through which sheets with toner images permanently affixed thereto are discharged onto the process kit 2. Further, an upper plate 18 is provided extending from the front end of the process kit 2. Therefore, a discharge tray 11 for placing thereon discharged sheets is composed of an upper surface of the main body 1 and the upper plate 18.

At the bottom of the main body 1, a tray 8 is provided for placing thereon the sheets to be fed to the process kit 2. Further, the optical system 9 which exposes the charged photoconductive layer of the photoreceptor drum 4 so as to form thereon a static latent image is provided along the circumference of the photoreceptor drum 4 on the side of the main body 1. In the state where the process kit 2 is installed in the main body 1, a portion below the main charger 5 of the photoconductive layer formed on the photoreceptor drum 4 is exposed by the optical system 9.

Along the circumference of the photoreceptor drum 4, the developer unit 10 is provided on the side of the main body 1. The developer unit 10 is provided for forming a toner image on the surface of the photoreceptor drum 4 using toner supplied thereto.

Along the circumference of the photoreceptor drum 4, the transfer unit 21 is also provided on the side of the main body 1, which transfers the toner image formed on the surface of the photoreceptor drum 4 to a sheet. The drum-shaped transfer unit 21 is arranged so as to be rotatable in the state where the process kit 2 is installed in the main body 1. The transfer unit 21 which integrally moves with the photoreceptor drum 4 transfers the toner image onto the sheet. The transfer unit 21 also conveys the sheet upward.

Figure 2:
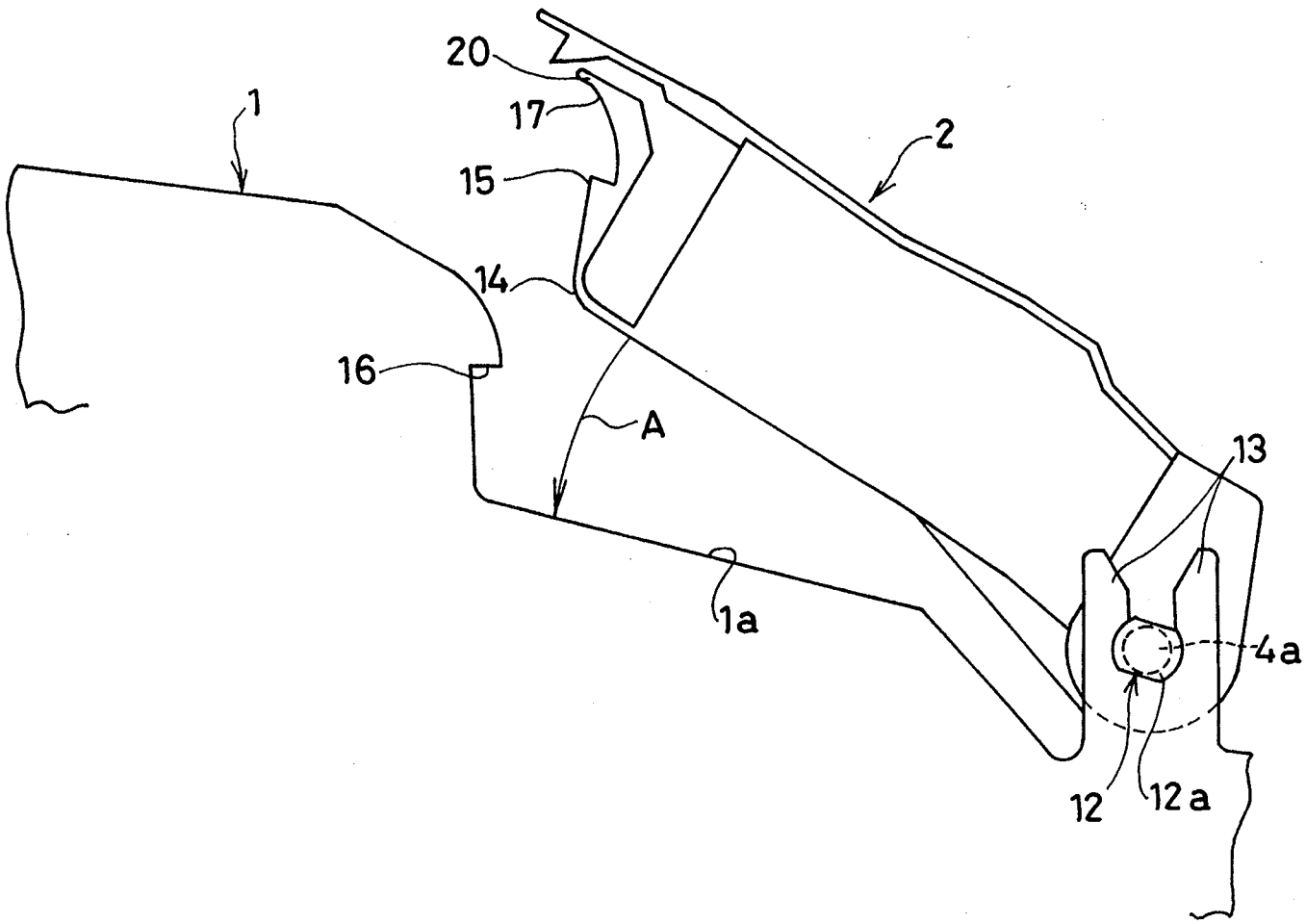
FIG. 2 is an explanatory view showing how a process kit is installed in a main body of the image forming apparatus.

As shown in FIG. 1 and FIG. 2, a pair of substantially cylindrical bearings 12 is provided on both sides of the back portion of the process kit 2, for supporting both ends of the rotation shaft 4*a* of the photoreceptor drum 4. The bearings 12 are coaxially provided with the rotation shaft 4*a*.

On the back end of the space 1*a* formed in the main body 1, a pair of guides 13 is provided for supporting the respective detachable bearings 12. Each of the guides 13 is formed in a substantially U-shape. The guides 13 are designed so as to guide and move the bearings 12 up and down in a direction perpendicular to the rotation shaft 4*a*.

Therefore, each of the bearings 12 serves as a rotation axis when installing or removing the process kit 2 in or from the main body 1.

At the end of each bearing 12, a flange 12*a* is formed so as to extend outward in the radial direction of the bearing 12. Each of the flanges 12*a* is formed so as to support the guide 13 between the process kit 2 and itself. In this arrangement, in the state where the process kit 2 is placed on each guide 13, the process kit 2 can rotate with respect to each guide 13 while its movement toward the rotation shaft 4*a* is controlled.

Figure 3:
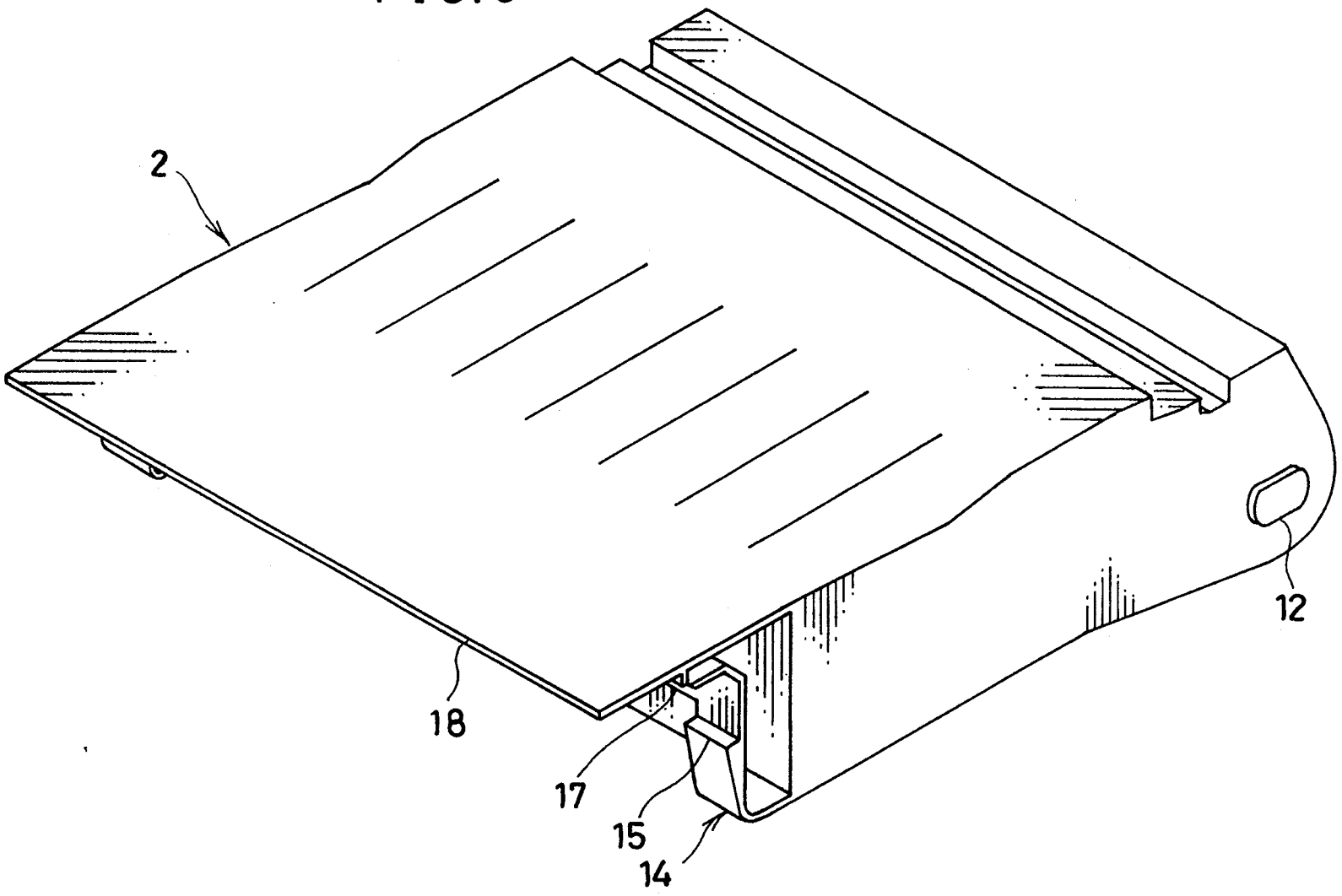
FIG. 3 is a perspective view of the process kit.

As shown in FIG. 2 and FIG. 3, a pair of ribs 14 is provided for ensuring the process kit 2 to the main body 1 at the front end sides (free end) of the process kit 2. These ribs 14 are made of synthetic resin which can be elastically deformed. The ribs 14 are provided so as to extend from the bottom corners of the process kit 2. The ribs 14 are bent upward in a direction parallel to the front face of the process kit 2. Further, a claw 15 which is projected outward is formed at the center of the front face of the ribs 14.

A plate-shaped handle 17 is formed at respective top ends of the ribs 14. The handle 17 is connected in a direction parallel to the rotation shaft 4*a*. Therefore, when carrying the process kit 2, the user can push his hand into the space between the claws 15, and grip the center of the handle 17 so as to lift up the process kit 2.

Figure 4:
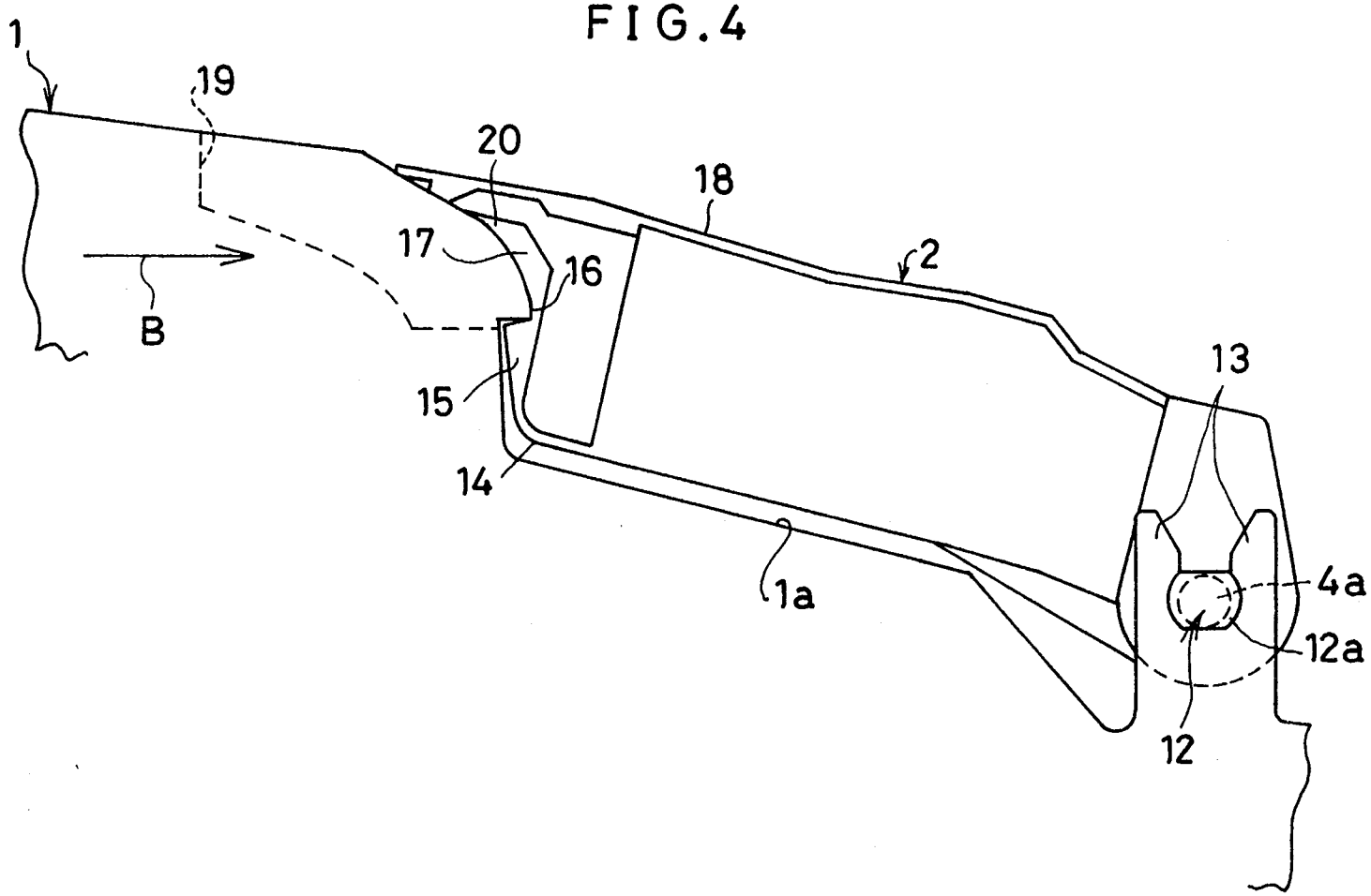
FIG. 4 is an explanatory view showing how the process kit is removed from the main body.
Figure 5:
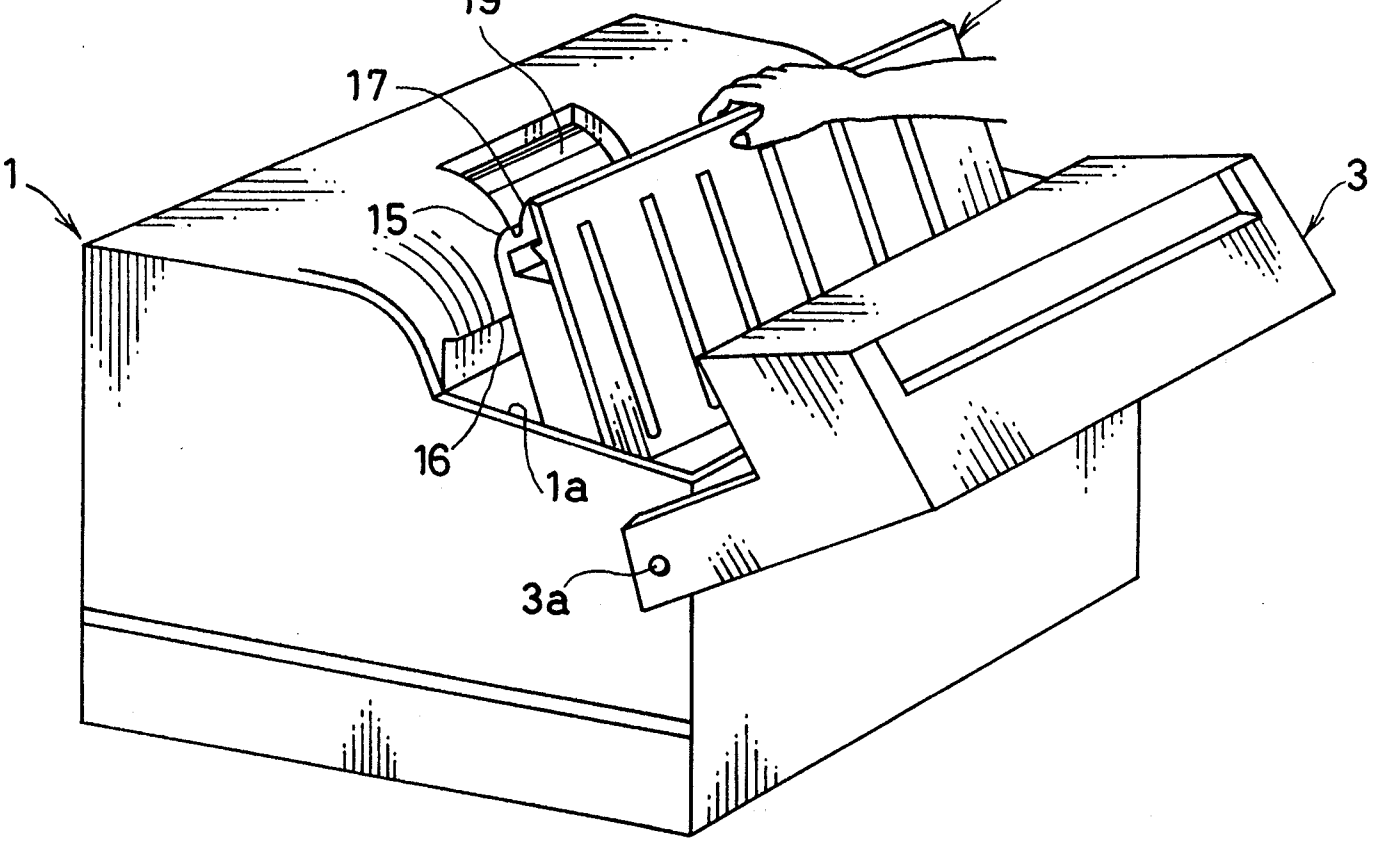
FIG. 5 is a perspective view of the image forming apparatus showing the state where the process kit is installed in or removed from the main body.

As shown in FIG. 4 and FIG. 5, in order to make the removal of the process kit 2 set in the space 1*a* easier, a recessed portion 19 facing the handle 17 is formed on the upper face of the main body 1. The recessed portion 19 is opened to the space 1*a*.

Therefore, when installing the process kit 2 into the space 1*a* or removing it therefrom, or when carrying it, since the rotation shaft 4*a* of the photoreceptor drum 4 (shown in FIG. 1) can be maintained horizontal, the used toner in the cleaning unit 6 of the process kit 2 can be prevented from shifting to one side. Therefore, an overflow of the used toner due to the toner shifting in the cleaning unit 6 can be prevented.

As shown in FIG. 2 and FIG. 4, at the front end of the handle 17, an extended portion 20 is formed so as to be bent forward. The extended portion 20 is arranged such that the end thereof comes in contact with the upper surface of the main body 1 when installing the process kit 2 in the main body 1.

In the above arrangement, when installing the process kit 2 in the main body 1, a hook 16 (to be described later) is supported between the claw 15 and the extended portion 20. In the meantime, each of the ribs 14 presses the hook 16 so as to ensure the process kit 2 to the main body 1.

The following will explain each operation of the laser printer. In the laser printer, when forming an image on a sheet, respective units operate in synchronous with one another. More concretely, charging by a main charger 5, exposure by the optical system 9, and developing by the developer unit 10 are carried out with the rotation of the photoreceptor drum 4.

In the meantime, the sheet is transported from the feed tray 8 to the process kit 2. When transporting the sheet from the main body 1 to the process kit 2, the sheet is set perpendicular to the rotation shaft 4*a* of the photoreceptor drum 4. Then, a toner image is transferred from the photoreceptor drum 4 to the sheet.

The sheet with the toner image transferred thereto is transported from the process kit 2 to the fuser 7 of the hood 3. Here, the sheet is set perpendicular to the rotation shaft 4*a* of the photoreceptor drum 4. The sheet on which the toner image is made permanent by the fuser 7 is discharged onto a discharge tray 11 provided on the respective upper surfaces of the process kit 2 and the main body 1.

Next, the installation and removal of the process kit 2 with respect to the main body 1 will be explained with reference to FIG. 2 and FIG. 5. As shown in the figures, first, the hood 3 is opened. Then, by holding the handle 17, each of the bearings 12 is inserted downward to each guide 13. Here, because both the bearings 12 and the guides 13 are exposed, the bearings 12 can be easily set on the respective guides 13.

Thereafter, the process kit 2 is rotated in a counterclockwise direction (in the direction of A in the figure) around each bearing 12 so as to support the hook 16 of the main body 1 between the claw 15 of each rib 14 and the extended portion 20. Here, each of the ribs 14 can be elastically deformed. As described, by accommodating the process kit 2 to the main body 1, the process kit 2 can be ensured to the main body 1. Then, the hood 3 is closed, and the installation of the process kit 2 is completed.

As shown in FIG. 4 and FIG. 5, when the process kit 2 is removed from the main body 1, after the hood 3 is opened, the user's hand is inserted into the recessed part 19 so as to grip the handle 17 to lift up the process kit 2. As a result, the ribs 14 are elastically deformed backward (in the direction of B in the figure), thereby cancelling the contact between the claw 15 and the hock 16. As described, as the process kit 2 is pulled upward griping the handle 17, the process kit 2 can be easily removed from the main body 1.

In the conventional model, when installing the process kit in the main body, since the process kit is contained within the main body, it is difficult to recognize the state of the process kit. Therefore, in the conventional model, there is a possibility of setting the process kit in a wrong position, and if this occurs, the image forming process may be adversely affected.

In order to counteract this, the process kit 2 of the present embodiment is arranged such that with the bearings 12 guided by the guides 13, the process kit 2 can be removably fit in the space 1*a* provided in the upper portion of the main body 1. Therefore, when installing and removing, since the process kit 2 can be exposed, the state of the process kit 2 can be recognized from outside, thereby eliminating the possibility of setting the process kit 2 in a wrong position of the main body 1. As a result, the installation and removal of the process kit 2 can be ensured.

Moreover, in the conventional model, the process kit is installed in or removed from the main body by moving it along the direction of the rotation shaft of the photoreceptor drum stored therein. In this arrangement, when the sheet gets stuck between the process kit and the main body, the smooth movement of the process kit is interfered, thereby hindering the installation and removal of the process kit. Furthermore, when the removal of the process kit is enforced, the sheet may be torn, and if this occurs, a long time is required to take out the damaged sheet.

However, in the arrangement of the present embodiment, even if the sheet gets stuck between the process kit 2 and the hood 3, or between the process kit 2 and the main body 1, the movement of the sheet in a transport direction and an appropriate bucking of the sheet can be ensured without being affected by the rotations of the process kit 2 and the hood 3. This can be achieved by setting the rotation axis of the process kit 2 and the hood 3 parallel to the rotation shaft 4*a* of the photoreceptor drum 4.

Therefore, even if the sheet gets stuck, this will not affect the smooth movement of the process kit 2 together with the hood 3 which covers the back portion of the main body 1. Moreover, the possibility of the sheet being damaged due to the rotation of the process kit 2 with the hood 3 can be eliminated. Thus, the damaged sheet can be easily taken out.

In the above embodiment, the process kit 2 is provided with the photoreceptor drum 4 and the cleaning unit 6 as one integral part. However, the present invention is not limited to this arrangement. For example, a process kit integrated with the developer 10 may be used as well Each of the bearings 12 is coaxially provided with the rotation shaft 4*a* of the photoreceptor drum 4. However, the bearings 12 may be set parallel to the rotation shaft 4*a*. Additionally, in replace of the bearings 12, the rotation shaft 4*a* can be extended in an axial direction so as to be respectively supported by each guide 13.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a photoreceptor drum for transferring an image formed on a peripheral surface thereof to a transfer material by rotating;

enclosing means for enclosing said photoreceptor drum said enclosing means provided with a handle on the side of a free end, for carrying said enclosing means;

a main body with a space for said enclosing means in an upper portion, the space enabling an installation and a removal of said enclosing means said main body includes a recessed portion facing said handle for inserting therein a user's hand when said enclosing means is fitted in the space;

a pair of projected members with a central axis thereof set parallel to a rotation shaft of said photoreceptor drum, said pair of projected members being secured to said enclosing means;

a pair of support members for respectively guiding said pair of projected members, and for removably supporting said pair of projected members so as to fit in the space;

said pair of projected member rotatable around an axis parallel to the rotation shaft of said photoreceptor drum with respect to said pair of support members in a state where said enclosing means is installed in said main body; and said enclosing means is installed in or removed from the upper portion of said main body by moving a portion of said enclosing means about the rotation shaft of said photoreceptor drum.

2. The image forming apparatus as set forth in claim 1, wherein:

said pair of projected members formed in a cylindrical shape is a pair of bearings, which coaxially supports the rotation shaft of said photoreceptor drum.

3. The image forming apparatus as set forth in claim 1, wherein:

said pair of support members includes an opening for guiding said pair of projected members by moving in a direction perpendicular to the rotation shaft of said photoreceptor drum.

4. The image forming apparatus as set forth in claim 1, wherein:

said pair of support members is a pair of guides with a portion formed in a substantially U-shape for guiding and supporting said pair of projected members.

5. The image forming apparatus as set forth in claim 1, wherein said handle is set parallel to the rotation shaft of said photoreceptor drum.

6. The image forming apparatus as set forth in claim 1, wherein:

said handle is formed at a position corresponding to a center of said photoreceptor drum in a direction of the rotation shaft thereof.

7. The image forming apparatus as set forth in claim 1, wherein:

said enclosing means includes cleaning means for removing toner remaining on the peripheral surface of said photoreceptor drum after transfer, and for storing used toner.

8. The image forming apparatus as set forth in claim 1, wherein:

said enclosing means includes developer means for supplying toner onto the peripheral surface of said photoreceptor drum.

9. The image forming apparatus as set forth in claim 1, wherein:

said enclosing means is a process kit.

10. An image forming apparatus comprising:

a photoreceptor drum for transferring an image formed on a peripheral surface thereof to a transfer material by rotation;

enclosing means for enclosing said photoreceptor drum;

a main body with a space for said enclosing means in an upper portion, the space enabling an installation and a removal of said enclosing means;

said enclosing means is installed in or removed from the upper portion of said main body by moving a portion of said enclosing means about the rotation shaft of said photoreceptor drum a pair of projected members with a central axis thereof set parallel to a rotation shaft of said photoreceptor drum, said pair of projected members being secured to said enclosing means said pair of projected member rotatable around an axis parallel to the rotation shaft of said photoreceptor drum with respect to said pair of support members in a state where said enclosing means is installed in said main body;

a pair of support members for respectively guiding said pair of projected members, and for removably supporting said pair of projected members so as to fit in the space; and lock means for securing said enclosing means to said main body so as to fit in the space, wherein said lock means includes:

an arm section which can be elastically deformed, said arm section being formed at a free end of said enclosing means; and a joint to be accommodated with said arm section, said joint being formed in said main body so as to face the space.

11. The image forming apparatus as set forth in claim 10, wherein:

said arm section includes a first projected portion provided at a central portion thereof, and an extended portion extending forward from a top end thereof;

said joint includes a second projected portion provided in said main body so as to enable it to face the first projected portion; and said enclosing means is secured so as to fit in the space by supporting the second projected portion between the first projected portion and the extended portion.

12. The image forming apparatus as set forth in claim 11, wherein:

said arm section is a rib, and the first projected portion is a claw, and the second projected portion is a hook.

13. An image forming apparatus comprising:

a photoreceptor drum with an image formed on a peripheral surface thereof to be transferred onto a transfer material by rotating;

enclosing means for enclosing therein said photoreceptor drum;

a main body with a space in an upper portion thereof for said enclosing means, said enclosing means being removably fit in said main body so as to cover the space;

fixing means for making a toner image permanent on a transfer sheet transported from said enclosing means;

a pair of projected members with a central axis thereof set parallel to a rotation shaft of said photoreceptor drum, said pair of projected members being secured to said enclosing means;

a pair of support members for respectively guiding said pair of projected members, and for removably supporting said pair of projected members so as to fit in the space, said enclosing means is installed in or removed from the upper portion of said main body by moving a portion of said enclosing means about the rotation shaft of said photoreceptor drum, and an upper face of said enclosing means forms a substantially flat portion with an upper face of said main body; and wherein said fixing means includes a hood which covers a back portion of said main body.

14. An image forming apparatus comprising:

a photoreceptor drum with an image formed on a peripheral surface thereof to be transferred onto a transfer material by rotating;

enclosing means for enclosing therein said photoreceptor drum;

a main body with a space in an upper portion thereof for said enclosing means, said enclosing means being removably fit in said main body so as to cover the space;

fixing means, provided above said photoreceptor drum, for making a toner image permanent on a transfer material transported from said enclosing means a pair of projected members with a central axis thereof set parallel to a rotation shaft of said photoreceptor drum, said pair of projected members being secured to said enclosing means;

a pair of support members for respectively guiding said pair of projected members, and for removably supporting said pair of projected members so as to fit in the space, said enclosing means installed in or removed from the upper portion of said main body by moving a portion of said enclosing means about the rotation shaft of said photoreceptor drum, and an upper face of said enclosing means forms a substantially flat portion with an upper face of said main body; and wherein said enclosing means serves as a discharge tray for storing a transfer material transported from said fixing means.

15. The image forming apparatus as set forth in claim 14, further comprising:

a pair of projected members with a central axis thereof set parallel to the rotation shaft of said photoreceptor drum, said pair of projected members being secured to said enclosing means; and a pair support members for respectively guiding said pair of projected members to said main body facing the space, and for removably supporting said pair of projected members so as to fit in the space.

16. The image forming apparatus as set forth in claim 14, wherein:

said fixing means rotates around an axis parallel to the rotation shaft of said photoreceptor drum so that said fixing means is mobile between a position at which installation and removal of said enclosing means in and from said main body are permitted and a position at which the transfer material can be fed from said photoreceptor drum, and said fixing means includes a hood for covering the upper portion of said main body so as to cover an upper portion of said photoreceptor drum when it is at the position where the transfer material can be fed from said photoreceptor drum.

17. The image forming apparatus as set forth in claim 14, further comprising:

a pair of projected members with a central axis thereof set parallel to the rotation shaft of said photoreceptor drum, said pair of projected members being secured to said enclosing means; and a pair of support members for respectively guiding said pair of projected members to said main body facing the space, and for removably supporting said pair of projected members so as to fit in the space.

18. An image forming apparatus comprising:

a photoreceptor drum with an image formed on a peripheral surface thereof to be transferred onto a transfer material by rotating;

enclosing means for enclosing therein said photoreceptor drum;

a main body with a space in an upper portion thereof, said enclosing means being removably fit in said main body so as to cover the space; and fixing means for making a toner image formed on the transfer material transported from said enclosing means permanent, wherein said fixing means is provided so that it is at a position above said photoreceptor drum when said enclosing means is installed in said main body, and said enclosing means is installed in or removed from the upper portion of said main body by moving a portion of said enclosing means about a rotation shaft of said photoreceptor drum, and an upper face of said enclosing means forms a substantially flat portion with an upper face of said main body, said enclosing means serving as a discharge tray for storing the transfer material transported from said fixing means.

19. The image forming apparatus as set forth in claim 18, wherein:

said fixing means rotates around an axis parallel to the rotation shaft of said photoreceptor drum so that said fixing means is mobile between a position at which installation and removal of said enclosing means in and from said main body are permitted and a position at which the transfer material can be fed from said photoreceptor drum, and said fixing means includes a hood for covering the upper portion of said main body so as to cover an upper portion of said photoreceptor drum when it is at the position where the transfer material can be fed from said photoreceptor drum.

* * * * *